US010590769B2

(12) United States Patent
Takeuchi et al.

(10) Patent No.: US 10,590,769 B2
(45) Date of Patent: Mar. 17, 2020

(54) SCROLL FLUID MACHINE

(71) Applicant: MITSUBISHI HEAVY INDUSTRIES THERMAL SYSTEMS, LTD., Minato-ku, Tokyo (JP)

(72) Inventors: Makoto Takeuchi, Tokyo (JP); Ei Onogawa, Tokyo (JP); Takayuki Kuwahara, Aichi (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 192 days.

(21) Appl. No.: 15/533,584

(22) PCT Filed: Dec. 7, 2015

(86) PCT No.: PCT/JP2015/084302
§ 371 (c)(1),
(2) Date: Jun. 6, 2017

(87) PCT Pub. No.: WO2016/098630
PCT Pub. Date: Jun. 23, 2016

(65) Prior Publication Data

US 2017/0342837 A1 Nov. 30, 2017

(30) Foreign Application Priority Data

Dec. 15, 2014 (JP) ..... 2014-252973

(51) Int. Cl.
*F04C 18/02* (2006.01)
*F01C 1/02* (2006.01)
*F01C 19/00* (2006.01)

(52) U.S. Cl.
CPC ..... *F01C 1/0215* (2013.01); *F01C 1/0246* (2013.01); *F01C 19/005* (2013.01);
(Continued)

(58) Field of Classification Search
CPC .... F01C 1/0215; F01C 1/0246; F01C 19/005; F04C 18/0215; F04C 18/0269;
(Continued)

(56) References Cited

U.S. PATENT DOCUMENTS 4,457,674 A * 7/1984 Kawano ..... F04C 18/0276 418/5
4,859,159 A * 8/1989 Leptien ..... F04C 18/0269 418/55.2
(Continued)

FOREIGN PATENT DOCUMENTS

CN 101680447 A 3/2010
CN 103321906 A 9/2013
(Continued)

OTHER PUBLICATIONS

English translation of DE 2406420 by Espacenet Feb. 6, 2019.*
(Continued)

*Primary Examiner* — Deming Wan
(74) *Attorney, Agent, or Firm* — Birch, Stewart, Kolasch & Birch, LLP.

(57) ABSTRACT

In a scroll fluid machine, a thinned section (26) is provided in correspondence with a position at which the wrap height of a spiral wrap (15B, 16B) changes due to a step part. The thinned section (26) is provided on the front-side surface or the rear-side surface of a tooth tip section of at least one of the spiral wraps (15B, 16B) of at least one of partner scrolls (15, 16) respectively engaging with scrolls (15, 16). The thinned section (26) is provided in the direction in which the wrap thickness decreases so as to extend over at least a reduced-machining-accuracy area (27), which is an area where the machining becomes discontinuous due to at least a change in the wrap height. Thus, a contact failure between the spiral wraps (15B, 16B) is avoided in the area where the machining accuracy relatively decreases as a result of
(Continued)

increasing the machining speed, thereby achieving both improved productivity and maintained performance.

4 Claims, 5 Drawing Sheets

(52) U.S. Cl.
CPC ..... *F04C 18/0215* (2013.01); *F04C 18/0269* (2013.01); *F04C 18/0276* (2013.01); *F04C 2230/91* (2013.01); *F05C 2201/021* (2013.01); *F05C 2201/0466* (2013.01)

(58) Field of Classification Search
CPC ..... F04C 18/0276; F04C 18/0246; B05B 2250/15; B05B 2250/25
See application file for complete search history.

(56) References Cited

U.S. PATENT DOCUMENTS

| | | | | |
|---|---|---|---|---|
| 2007/0292293 | A1* | 12/2007 | Fujita | F01C 21/02 418/55.2 |
| 2013/0251576 | A1 | 9/2013 | Hirata et al. | |

FOREIGN PATENT DOCUMENTS

| | | | | | |
|---|---|---|---|---|---|
| DE | 2406420 | A1 | * | 8/1974 | F01C 19/005 |
| EP | 2 154 375 | A1 | | 2/2010 | |
| EP | 2484909 | A1 | | 8/2012 | |
| EP | 2740938 | A1 | | 6/2014 | |
| JP | 63201385 | A | * | 8/1988 | |
| JP | 01069788 | A | * | 3/1989 | F04C 18/0246 |
| JP | 01134086 | A | * | 5/1989 | F04C 18/0246 |
| JP | 6-299978 | A | | 10/1994 | |
| JP | 8-4669 | A | | 1/1996 | |
| JP | 10089268 | A | * | 4/1998 | F04C 18/0246 |
| JP | 2004-245059 | A | | 9/2004 | |
| JP | 2005-23817 | A | | 1/2005 | |
| JP | 2005-61295 | A | | 3/2005 | |
| JP | 2007-224775 | A | | 9/2007 | |
| JP | 2008-297977 | A | | 12/2008 | |
| JP | 2011-74884 | A | | 4/2011 | |
| JP | 2011074884 | A | * | 4/2011 | F04C 18/0269 |
| JP | 2012-137000 | A | | 7/2012 | |
| JP | 2013-36366 | A | | 2/2013 | |
| JP | 2014-1692 | A | | 1/2014 | |
| JP | 2018009553 | A | * | 1/2018 | F04C 18/0253 |
| WO | WO 2011/040341 | A1 | | 4/2011 | |

OTHER PUBLICATIONS

Office Action dated Jul. 2, 2018 for corresponding Chinese Application No. 201580066851.9 with an English Translation.
Office Action dated Sep. 11, 2018 for corresponding Japanese Patent Application No. 2014-252973 with an English Translation.

* cited by examiner

SCROLL FLUID MACHINE

TECHNICAL FIELD

The present invention relates to a scroll fluid machine that can be applied to a compressor or a pump, an expander, and the like.

BACKGROUND ART

A scroll fluid machine is provided with a pair of a stationary scroll and an orbiting scroll. The scrolls each include an end plate with a spiral wrap disposed in an upright manner thereon. The pair of the stationary scroll and the orbiting scroll are engaged by opposing their spiral wraps with a 180 degree phase difference, thus forming a sealed chamber between the scrolls. As a result, the scroll fluid machine is configured to supply and discharge fluid. In such a scroll fluid machine, a scroll compressor for example, a two-dimensional compression structure is generally adopted in which the wrap heights of the spiral wraps of the stationary scroll and the orbiting scroll are set to be constant over the entire length in the spiral direction, a compression chamber is caused to move from the outer circumferential side to the inner circumferential side while gradually having its capacity reduced, and the fluid is compressed in the circumferential direction of the spiral wraps.

Meanwhile, in order to improve efficiency of the scroll compressor and to achieve downsizing and weight-reduction thereof, a three-dimensional compression-type scroll compressor has been proposed. Such a three-dimensional compression-type scroll compressor has a structure in which a step part is provided at a predetermined position, along the spiral direction, on each of the tooth crest and the tooth base of the spiral wraps of the stationary scroll and the orbiting scroll, such that the step part forms a boundary at which the wrap height of the spiral wraps transitions from higher on the outer circumferential side to lower on the inner circumferential side. By causing the height of the compression chamber in the axial direction to be higher on the outer circumferential side of the spiral wraps than on the inner circumferential side thereof, the fluid is compressed both in the circumferential direction and the height direction of the spiral wraps.

In such a scroll fluid machine, the spiral wraps of the stationary scroll and the orbiting scroll are normally machined by an end mill. However, due to machining problems (mainly due to factors such as changes in a pressing force of the tool and wear of the tooth tip), a taper-shaped protrusion (hereinafter also referred to as a reduced machining-accuracy area) is susceptible to being formed at a base portion of the spiral wrap. As a result, a gap is generated between the spiral wraps due to a contact failure, this gap becoming a cause of gas leaks. As countermeasures against the problem, as disclosed in Patent Documents 1 and 2, for example, a scroll fluid machine is known in which tapered chamfering and the like is carried out on a tooth tip section of the spiral wrap of a partner scroll.

Further, in Patent Documents 3 and 4, and the like, a scroll fluid machine is disclosed in which, in order to prevent an increase in wear and stress caused by the orbiting scroll interfering with the partner scroll as a result of being tilted or becoming thermally deformed when driven to orbit, the front-side surface or the rear-side surface of the tooth tip section of each of the spiral wraps is provided with a relief portion, a thinned section and the like in the direction in which the wrap thickness decreases, thereby inhibiting the interference between the orbiting scroll and the partner scroll.

CITATION LIST

Patent Document

Patent Document 1: Japanese Unexamined Patent Application Publication No. 2005-23817A Patent Document 2: Japanese Unexamined Patent Application Publication No. 2008-297977A Patent Document 3: Japanese Unexamined Patent Application Publication No. 2004-245059A Patent Document 4: Japanese Unexamined Patent Application Publication No. 2011-74884A

SUMMARY OF INVENTION

Technical Problem

As described above, for the stationary scroll and the orbiting scroll of the scroll fluid machine, the problem exists in which, due to the issues of machining using the end mill, machining accuracy deteriorates at the base portion of the spiral wrap and the taper-shaped protrusion is susceptible to being formed. This problem is not only caused by the pressing force or wear of the tool, and if a scroll machining speed is increased in order to achieve improved productivity, deformation of the spiral wrap becomes even more evident. Specifically, the rigidity of the spiral wrap is greater at the base portion than on the tooth tip portion side, and when the machining speed is increased, the taper-shaped protrusion at the base portion is susceptible to being formed, and machining accuracy deteriorates.

In particular, in the scroll compressor having the three-dimensional compression structure, the wrap height of the spiral wrap changes at the step part, and, in comparison to the scroll compressor having the two-dimensional compression structure, there is a tendency for the machining speed to have a greater impact on machining accuracy of the base portion. Thus, in the vicinity of the step part where the wrap height changes suddenly, the machining accuracy deteriorates in a discontinuous manner, becoming the cause of gas leaks and leading to a deterioration in performance.

In light of the foregoing, an object of the present invention is to provide a scroll fluid machine capable of avoiding a contact failure between spiral wraps in an area where machining accuracy relatively decreases as a result of increasing the machining speed, and of achieving both improved productivity and maintained performance.

Solution to Problem

In order to solve the above-described problem, a scroll fluid machine of the present invention provides the following means.

Specifically, a scroll fluid machine according to the present invention includes: a pair of a stationary scroll and an orbiting scroll provided with vertically-disposed spiral wraps on end plates thereof, the spiral wraps being mutually opposed to and engaged with each other; a step part that is higher on a center side and lower on an outer circumferential side along the spiral wrap provided on the end plate of at least one of the stationary scroll and the orbiting scroll; a step part that is lower on the center side and higher on the outer circumferential side along the spiral wrap provided on the spiral wrap of the other one of the stationary scroll and the orbiting scroll, in correspondence with the step part of the end plate; and a thinned section, which corresponds to a position at which a wrap height of the spiral wrap changes due to the step part, provided on a front-side surface or a rear-side surface of a tooth tip section of at least one of the spiral wraps of at least one of the partner scrolls engaging with the scroll, in a direction in which a wrap thickness decreases, so as to extend over at least an area where machining becomes discontinuous due to the change in the wrap height.

According to the present invention, the so-called stepped scroll fluid machine has a configuration in which the thinned section, which corresponds to the position at which the wrap height of the spiral wrap changes due to the step part, is provided on the front-side surface or the rear-side surface of the tooth tip section of at least one of the spiral wraps of at least one of the partner scrolls engaging with the scroll, in the direction in which the wrap thickness decreases, so as to extend over at least the area where the machining becomes discontinuous due to the change in the wrap height. By increasing the scroll machining speed, the machining accuracy deteriorates in a discontinuous manner in the vicinity of the step part at which the wrap height of the spiral wrap suddenly changes. As a result of the thinned section being provided on the front-side surface or the rear-side surface of the tooth tip section of at least one of the spiral wraps of at least one of the partner scrolls, in the direction in which the wrap thickness decreases, so as to extend over the section in which the machining accuracy is likely to deteriorate, a contact failure between the spiral wraps that is caused by the reduced machining-accuracy area can be avoided. Therefore, both improved productivity resulting from increasing the scroll machining speed, and maintenance of compression performance resulting from avoiding the contact failure between the spiral wraps, which causes gas leaks, can be achieved.

Further, in the scroll fluid machine of the present invention, with respect to the above-described scroll fluid machine, the thinned section is formed by applying a surface treated film onto a wrap surface of the spiral wrap excluding the thinned section.

According to the present invention, the thinned section is formed by applying the surface treated film onto the wrap surface of the spiral wrap excluding the thinned section. Thus, when applying the surface treated film onto the wrap surface of the spiral wrap, by applying the surface treated film while masking the thinned section, the thinned section can be formed without carrying out any special processing. Examples of the surface treated film include an alumite film formed by anodizing the surface of an aluminum material, a fluorine-based resin (PTFE) film, a nickel/phosphorous film, or a nickel/boron film. Specifically, by applying the surface treated film of a predetermined thickness onto the section excluding the thinned section, the thinned section can be easily formed on a required section of the spiral wrap in a low-cost manner, without any additional cost.

Further, a scroll fluid machine according to the present invention includes: a pair of a stationary scroll and an orbiting scroll provided with vertically-disposed spiral wraps on end plates thereof, the spiral wraps being mutually opposed to and engaged with each other. A thinned section is provided on a front-side surface or a rear-side surface of a tooth tip section of at least one of the spiral wraps of at least one of the stationary scroll and the orbiting scroll in a direction in which a wrap thickness decreases, and the thinned section is formed by applying a surface treated film onto a wrap surface of the spiral wrap excluding the thinned section.

According to the present invention, in the scroll fluid machine provided with the pair of the stationary scroll and the orbiting scroll that are engaged with each other, the thinned section is provided on the front-side surface or the rear-side surface of the tooth tip section of at least one of the spiral wraps of at least one of the stationary scroll and the orbiting scroll in the direction in which the wrap thickness decreases. Since this thinned section is formed by applying the surface treated film onto the wrap surface of the spiral wrap excluding the thinned section, when the scroll machining speed is increased, a taper-shaped protrusion and the like is formed on a highly-rigid base portion of the spiral wrap, and the machining accuracy deteriorates. In response to this, the thinned section is provided on the front-side surface or the rear-side surface of the tooth tip section of at least one of the spiral wraps of at least one of the partner scrolls. When applying the surface treated film onto the wrap surface of the spiral wrap, by applying the surface treated film while masking the thinned section, the thinned section can be formed without carrying out any special processing. Examples of the surface treated film include the alumite film formed by anodizing the surface of the aluminum material, the fluorine-based resin (PTFE) film, the nickel/phosphorous film, or the nickel/boron film. Therefore, by simply applying the surface treated film of the predetermined thickness onto the section excluding the thinned section, the thinned section can be easily formed without any additional cost. Further, both the improved productivity resulting from increasing the scroll machining speed, and the maintenance of the compression performance resulting from avoiding the contact failure between the spiral wraps, which causes gas leaks, can be achieved.

Further, a scroll fluid machine according to the present invention includes: a pair of a stationary scroll and an orbiting scroll provided with vertically-disposed spiral wraps on end plates thereof, the spiral wraps being mutually opposed to and engaged with each other. A thinned section is provided on a front-side surface or a rear-side surface of a base section of at least one of the spiral wraps of at least one of the stationary scroll and the orbiting scroll in a direction in which a wrap thickness decreases, and the thinned portion is formed by applying a surface treated film onto a wrap surface of the spiral wrap excluding the thinned section.

According to the present invention, in the scroll fluid machine provided with the pair of the stationary scroll and the orbiting scroll that are engaged with each other, the thinned section is provided on the front-side surface or the rear-side surface of the base section of at least one of the spiral wraps of at least one of the stationary scroll and the orbiting scroll in the direction in which the wrap thickness decreases, and the thinned portion is formed by applying the surface treated film onto the wrap surface of the spiral wrap excluding the thinned section. Thus, although the taper-shaped protrusion and the like is formed on the highly-rigid base portion of the spiral wrap, and the machining accuracy deteriorates when the scroll machining speed is increased, the thinned section, which includes the reduced machining-accuracy area, is provided on the front-end surface or the rear-end surface of the base section of at least one of the spiral wraps of at least one of the scrolls. When applying the surface treated film onto the wrap surface of the spiral wrap, by applying the surface treated film while masking the thinned section, the thinned section can be formed so as to include the reduced machining-accuracy area without carrying out any special processing. Examples of the surface treated film include the alumite film formed by anodizing the surface of the aluminum material, the fluorine-based resin (PTFE) film, the nickel/phosphorous film, or the nickel/boron film. Therefore, by simply applying the surface treated film of the predetermined thickness onto the section excluding the thinned section, the thinned section can be easily formed without any additional cost. Further, both the improved productivity resulting from increasing the scroll machining speed, and the maintenance of the compression performance resulting from avoiding the contact failure between the spiral wraps, which causes gas leaks, can be achieved.

Advantageous Effects of Invention

According to the present invention, although the machining accuracy deteriorates in the vicinity of the step parts, at which the wrap height of the spiral wrap suddenly changes, as a result of increasing the machining speed, by providing the thinned section on the front-side surface or the rear-side surface of the tooth tip section of at least one of the spiral wraps of at least one of the partner scrolls, in the direction in which the wrap thickness decreases, so as to extend over the section in which the machining accuracy is likely to deteriorate, the contact failure between the spiral wraps caused by the reduced machining-accuracy area can be avoided. Thus, both the improved productivity resulting from increasing the scroll machining speed, and the maintenance of the compression performance resulting from avoiding the contact failure between the spiral wraps, which causes gas leaks, can be achieved.

Further, according to the present invention, when the scroll machining speed is increased, the taper-shaped protrusion and the like is formed on the highly-rigid base portion of the spiral wrap, and the machining accuracy deteriorates. However, in response to this, the thinned section is provided on the front-end surface or the rear-end surface of the tooth tip section of at least one of the spiral wraps of at least one of the partner scrolls. When applying the surface treated film onto the wrap surface of the spiral wrap, by applying the surface treated film while masking the thinned section, the thinned section can be formed without carrying out any special processing. Examples of the surface treated film include the alumite film formed by anodizing the surface of the aluminum material, the fluorine-based resin (PTFE) film, the nickel/phosphorous film, or the nickel/boron film. Therefore, by simply applying the surface treated film of the predetermined thickness onto the section excluding the thinned section, the thinned section can be easily formed without any additional cost. Further, both the improved productivity resulting from increasing the scroll machining speed, and the maintenance of the compression performance resulting from avoiding the contact failure between the spiral wraps, which causes gas leaks, can be achieved.

DESCRIPTION OF EMBODIMENTS

Embodiments of the present invention will be described below with reference to the drawings.

First Embodiment

A first embodiment of the present invention will be described below with reference to FIGS. 1 to 5.

Figure 1:
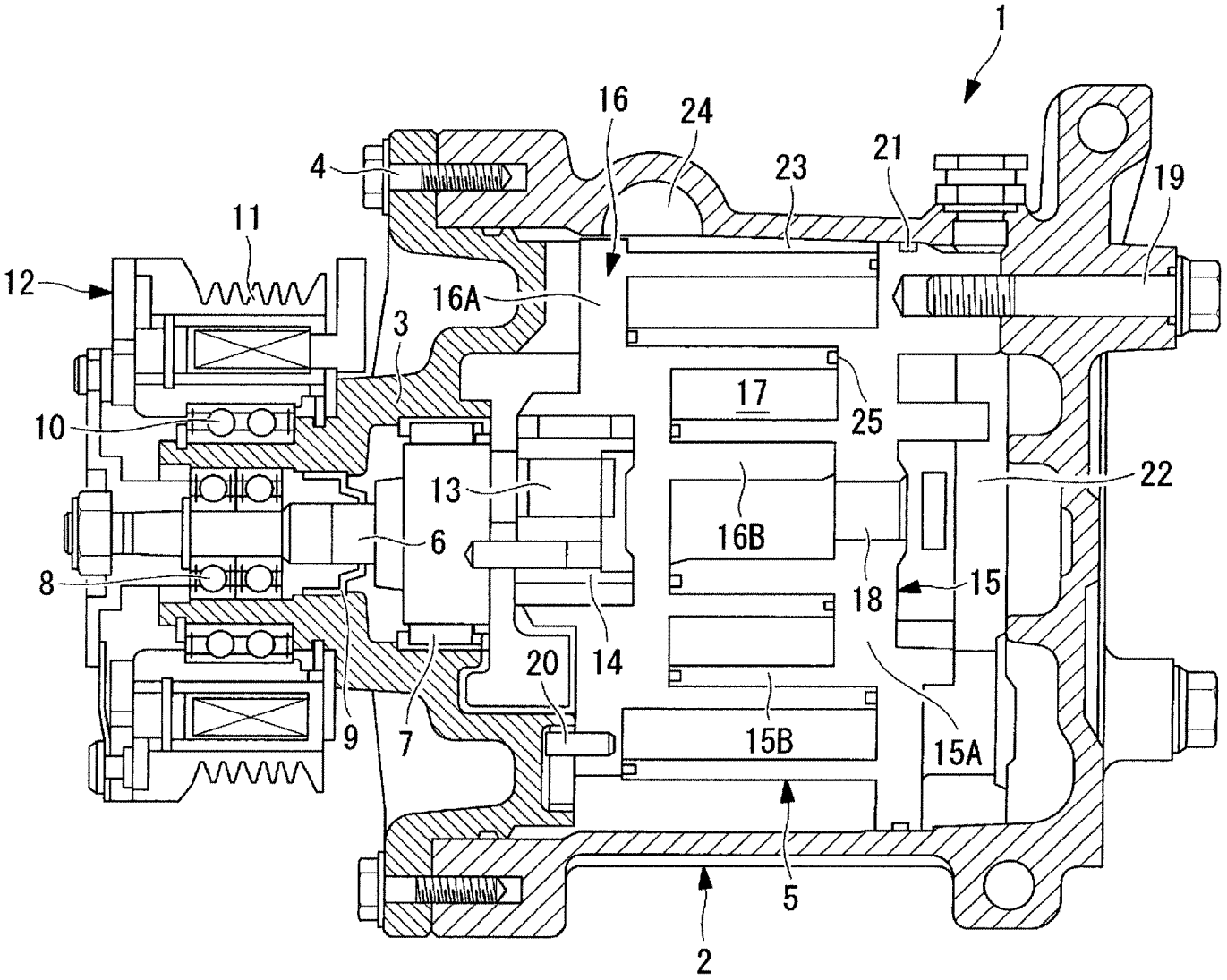
FIG. 1 is a vertical cross-sectional view of a scroll fluid machine according to a first embodiment of the present invention.
Figure 2A:
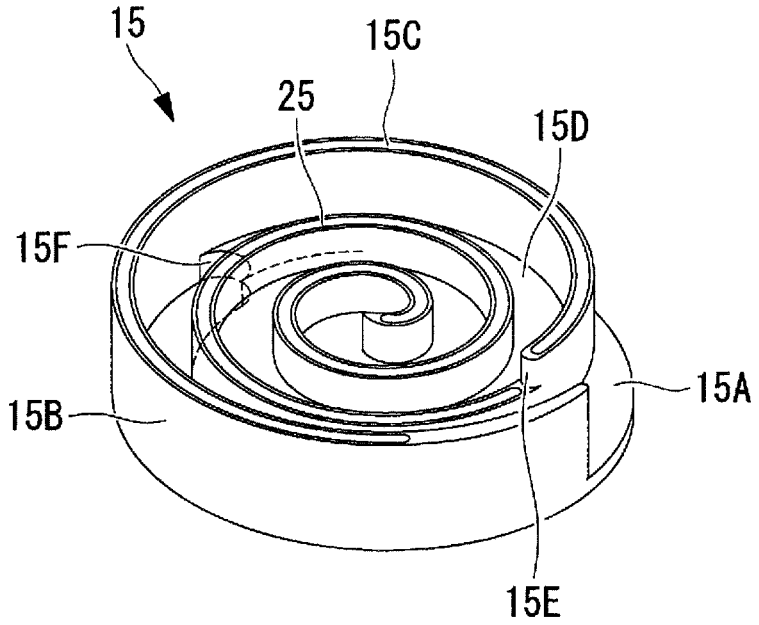
FIGS. 2A and 2B are perspective views of a stationary scroll and an orbiting scroll of the scroll fluid machine.
Figure 2B:
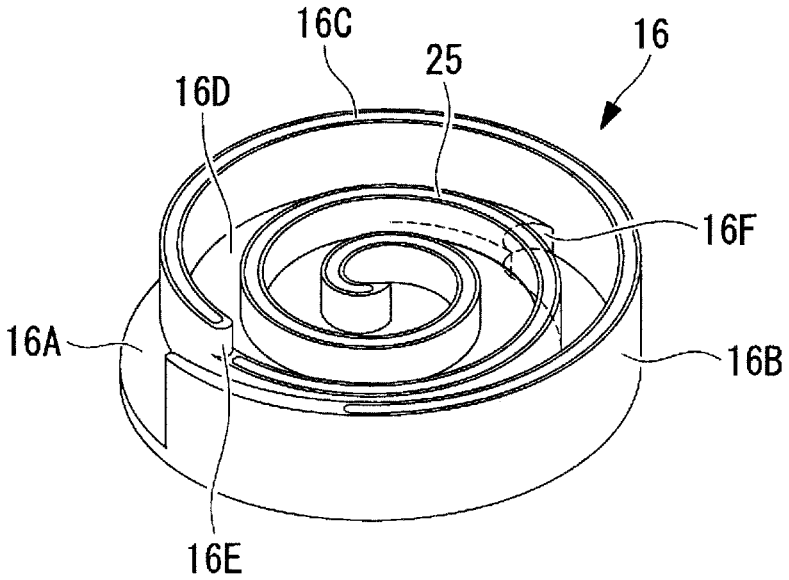
Figure 3:
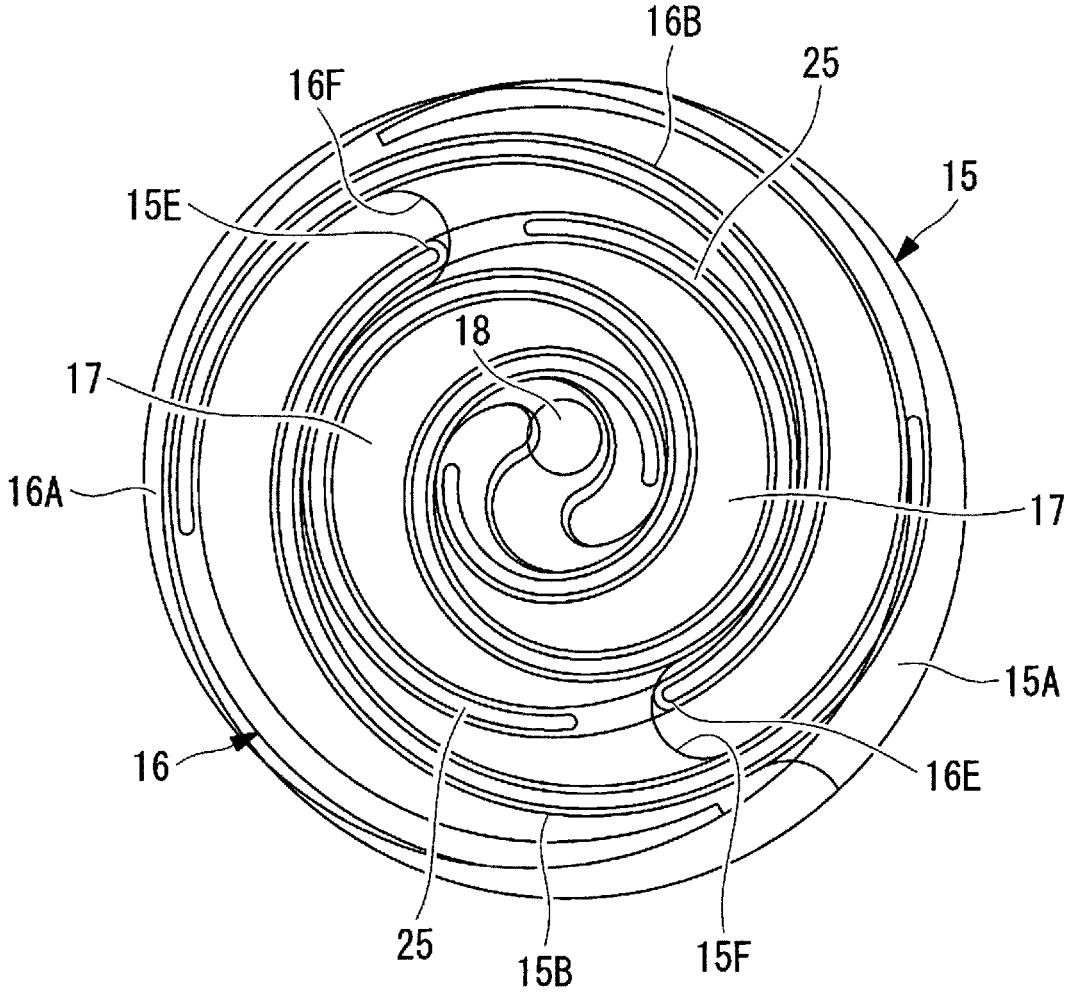
FIG. 3 is a diagram illustrating an engaged state of the stationary scroll and the orbiting scroll at a given swivel angle position.

FIG. 1 is a vertical cross-sectional view of a scroll fluid machine according to the first embodiment of the present invention. FIGS. 2A and 2B are perspective views of a stationary scroll and an orbiting scroll of the scroll fluid machine, and FIG. 3 illustrates an engaged state of the stationary scroll and the orbiting scroll.

Here, as an example of the scroll fluid machine, an example will be described in which the present invention is applied to an open-type scroll compressor 1 that is driven by obtaining an external motive power.

As illustrated in FIG. 1, the open-type scroll compressor (scroll fluid machine) 1 is provided with a housing 2 that configures an outline of the open-type scroll compressor 1. This housing 2 is a cylinder with an open front end side and a sealed rear end side. By fastening and fixing a front housing 3 into the opening on the front end side using bolts 4, a sealed space is formed in the interior of the housing 2, and a scroll compression mechanism 5 and a drive shaft 6 are incorporated in the sealed space.

The drive shaft 6 is rotatably supported by the front housing 3 via a main bearing 7 and an auxiliary bearing 8. A pulley 11, which is rotatably provided on an outer circumferential portion of the front housing 3 via a bearing 10, is connected, via an electromagnetic clutch 12, to a front end portion of the drive shaft 6, which protrudes to the outside from the front housing 3 via a mechanical seal 9, such that the external motive power can be transmitted. A crank pin 13, which is eccentric by a predetermined dimension, is integrally provided on the rear end of the drive shaft 6, and is connected to an orbiting scroll 16 of the scroll compression mechanism 5 described below, via a known slave crank mechanism 14 that includes a drive bushing having a variable turn radius.

In the scroll compression mechanism 5, a pair of compression chambers 17 are formed between a stationary scroll 15 and the orbiting scroll 16, as a result of the stationary and orbiting scrolls 15 and 16 being engaged with each other with a 180 degree phase difference. The scroll compression mechanism 5 is configured to compress a fluid (a refrigerant gas) by moving each of the compression chambers 17 from an outer circumferential position to a center position while gradually reducing the capacity thereof. A discharge port 18, which discharges compressed gas, is provided in a center section of the stationary scroll 15, and the stationary scroll 15 is fixedly provided on a bottom wall surface of the housing 2 via bolts 19. Further, the orbiting scroll 16 is connected to the crank pin 13 of the drive shaft 6 via the slave crank mechanism 14, and is supported by a thrust bearing surface of the front housing 3, via a known self-rotation prevention mechanism 20, such that the orbiting scroll 16 can freely orbit and turn.

An O-ring 21 is provided around the outer circumference of an end plate 15A of the stationary scroll 15. As a result of the O-ring 21 making close contact with the inner circumferential surface of the housing 2, the internal space of the housing 2 is partitioned into a discharge chamber 22 and an intake chamber 23. The discharge port 18 opens into the discharge chamber 22. The compressed gas from the compression chambers 17 is discharged from the discharge port 18, and then discharged to a refrigeration cycle side therefrom. Further, an intake port 24, which is provided in the housing 2, opens into the intake chamber 23. A low-pressure gas, which has circulated through the refrigeration cycle, is taken into the intake port 24, and then, the refrigerant gas is taken into the interior of the compression chambers 17 via the intake chamber 23.

Further, the pair of the stationary scroll 15 and the orbiting scroll 16 include spiral wraps 15B and 16B disposed in an upright manner on the end plate 15A and an end plate 16A, respectively. As illustrated in FIGS. 2A and 2B, the stationary scroll 15 and the orbiting scroll 16 are respectively provided with step parts 15E and 15F and step parts 16E and 16F at predetermined positions of tooth crests 15C and 16C and tooth bases (end plate surfaces) 15D and 16D of the spiral wraps 15B and 16B along the spiral direction, and are configured such that the wrap height of each of the spiral wraps 15B and 16B is higher on the outer circumferential side and lower on the inner circumferential side, demarcated by the step parts 15E, 15F, 16E, and 16F.

As illustrated in FIGS. 1 to 3, the pair of the stationary scroll 15 and the orbiting scroll 16 are engaged with each other with the respective centers being separated from each other by the amount of a turn radius and with a 180 degree phase difference between the spiral wraps 15B and 16B. Further, the pair of the stationary scroll 15 and the orbiting scroll 16 are assembled such that a predetermined tip gap is set between the tooth crests 15B and 16B and the tooth bases (end plate surfaces) 15D and 16D of the respective spiral wraps 15B and 16B at a normal temperature. As a result, the pair of compression chambers 17 delimited by the end plates 15A and 16A and by the spiral wraps 15B and 16B are formed between the scrolls 15 and 16 so as to be symmetrical relative to the scroll centers, and the orbiting scroll 16 is driven to orbit and turn smoothly around the stationary scroll 15.

As illustrated in FIG. 1, the above-described compression chambers 17 are configured such that the height thereof in the axial direction becomes higher on the outer circumferential side of the spiral wraps 15B and 16B than on the inner circumferential side thereof. As a result, when the compression chambers 17 compress the fluid by moving from the outer circumferential side to the center side while reducing the capacity thereof, the scroll compression mechanism 5 capable of three-dimensional compression is configured to perform the compression both in the circumferential direction and in the wrap height direction of the spiral wraps 15B and 16B. Note that tip seals 25 are respectively disposed on the tooth crests 15C and 16C of the spiral wraps 15B and 16B in a known manner.

In such a stepped scroll compressor 1, the spiral wraps 15B and 16B of the stationary scroll 15 and the orbiting scroll 16 are each configured such that the wrap height thereof is higher on the outer circumferential side than on the inner circumferential side, being respectively demarcated by the step parts 15E and 15F, and 16E and 16F, such that the wrap height suddenly changes at the step parts 15E and 15F, and 16E and 16F. Thus, when machining the spiral wraps 15B and 16B using an end mill, for example, machining conditions change at the step parts 15E and 15F, and 16E and 16F. This configuration has led to the problem in which the machining accuracy deteriorates in a discontinuous manner in the vicinity of the step parts, and a taper-shaped protrusion (a reduced machining-accuracy area 27) or the like is susceptible to being formed at a base portion of the spiral wrap 15B and 16B, for example.

Figure 4:
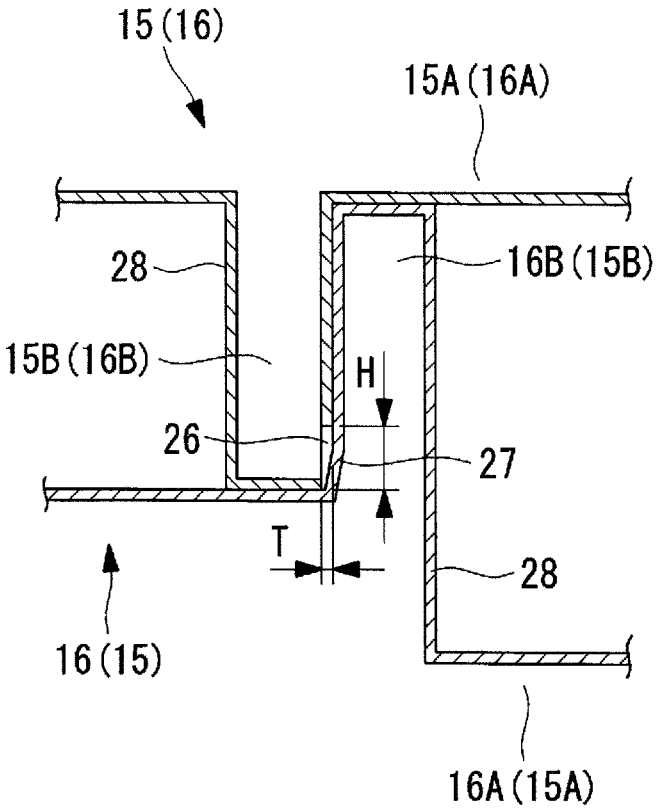
FIG. 4 is a cross-sectional view illustrating an engaged state of the stationary scroll and the orbiting scroll at a step part position.
Figure 5:
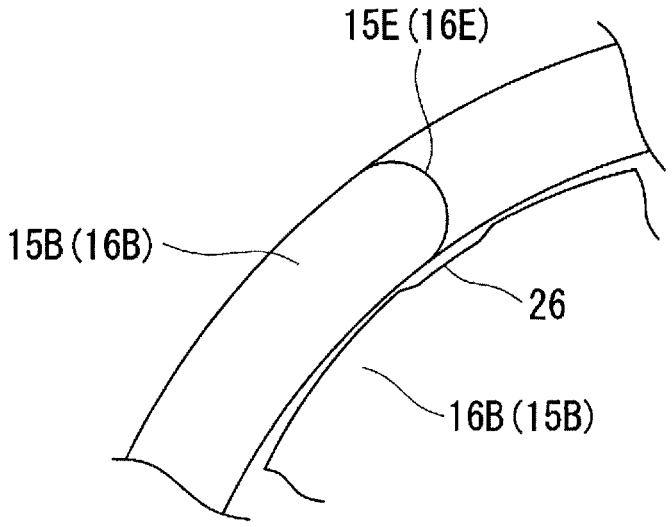
FIG. 5 is a plan view illustrating an engaged state of the stationary scroll and the orbiting scroll at the step part position.

In order to solve this problem, in the present embodiment, as illustrated in FIGS. 4 and 5, a thinned section 26 is provided on the front-side surface or the rear-side surface of a tooth tip section of at least one or both of the spiral wraps 15B and 16B of at least one of the partner scrolls 15 and 16 that engages with the scroll 15 and 16, so as to correspond to a position at which the wrap height of each of the spiral wraps 15B and 16B changes due to the step parts 15E and 15F, and 16E and 16F. The thinned section 26 is provided in a direction in which the wrap thickness decreases, over at least an area where the machining becomes discontinuous due to the change in wrap height (the reduced machining-accuracy area 27), thus enabling a contact failure between the spiral wraps 15B and 16B resulting from the influence of the reduced machining-accuracy area 27 to be avoided.

The thinned section 26 is configured such that a height-direction dimension H and a thickness-direction dimension T thereof are respectively slightly larger than a wrap height-direction dimension and a thickness-direction dimension of the reduced machining-accuracy area 27 that is formed at the base portion of the spiral wrap 15B and 16B. With respect to the dimensions H and T, it is sufficient that the height-direction dimension H is set to be approximately from 1 to 10 mm, and the thickness-direction dimension T is set to be approximately 10 μm, for example. Note that it is sufficient that the width-direction dimension along the spiral direction has a width-direction dimension wide enough to extend over at least the area where the machining becomes discontinuous due to the change in the wrap height (the reduced machining-accuracy area 27). Further, the thinned section 26 is preferably not provided at both end sides, in order to minimize gaps allowing gas leaks as much as possible.

Further, if the above-described thinned section 26 is formed by a cutting process, additional machining costs are incurred. Thus, the thinned section 26 is formed at the same time as a surface treated film 28 is applied onto surfaces including wrap surfaces of the spiral wraps 15B and 16B of the stationary scroll 15 and the orbiting scroll 16.

Specifically, because the spiral wraps 15B and 16B of the stationary scroll 15 and the orbiting scroll 16 engage with each other and slide, in order to reduce abrasion and sliding friction or to prevent mutual sticking and the like, the surface treated film 28 is applied onto the surfaces of the spiral wraps 15B and 16B (preferably applied to the sliding portion). Examples of the surface treated film 28 include an alumite film formed by anodizing the surface of an aluminum material, a fluorine-based resin (PTFE) film, a nickel/phosphorous film, and a nickel/boron film. When applying the surface treated film 28 in this manner, by carrying out the surface treatment while masking the thinned section 26, the thinned section 26 corresponding to the thickness of the surface treated film 28 can be formed over a range of the masking at the same time as the surface treatment is carried out, and the cutting process can be omitted.

As a result, according to the present embodiment, the following effect can be obtained.

In the above-described stepped scroll compressor 1, the orbiting scroll 16 is driven by the drive shaft 6 so as to orbit and turn about the stationary scroll 15 via the slave crank mechanism 14. As a result, each of the compression chambers 17 formed between the mutually engaged spiral wraps 15B and 16B moves from the outer circumferential position to the center position while reducing the capacity thereof. In this way, the fluid (the refrigerant gas) that has been taken into the compression chambers 17 is compressed in a three-dimensional manner, and is discharged into the discharge chamber 22 from the discharge port 18.

At this time, even when the reduced machining-accuracy area 27 exists, which is generated due to a technical problem relating to the machining of the stationary scroll 15 and the orbiting scroll 16, and which affects the engagement between the spiral wraps 15B and 16B, in order to suppress gas leaks and maintain compression performance, it is important to reliably maintain the mutual engagement between the spiral wraps 15B and 16B and to prevent formation of the gap allowing gas leaks as a result of the contact failure between the spiral wraps 15B and 16B.

The present embodiment has a configuration in which the thinned section 26 is provided on the front-side surface or the rear-side surface of the tooth tip section of at least one or both of the spiral wraps 15B and 16B of at least one of the partner scrolls 15 and 16 that engages with the scroll 15 and 16, so as to correspond to the position at which the wrap height of each of the spiral wraps 15B and 16B changes due to the step parts 15E and 15F, and 16E and 16F. The thinned section 26 is provided in the direction in which the wrap thickness decreases, over at least the reduced machining-accuracy area 27 generated as a result of the machining becoming discontinuous due to the change in the wrap height.

Thus, although the machining accuracy deteriorates in the discontinuous manner in the vicinity of the step parts 15E and 15F, and 16E and 16F, at which the wrap height of the spiral wraps 15B and 16B suddenly changes, as a result of increasing the machining speed of the scrolls 15, 16, by providing the thinned section 26 in the front-side surface or the rear-side surface of the tooth tip section of at least one or both of the spiral wraps 15B and 16B of at least one of the partner scrolls 15 and 16, in the direction in which the wrap thickness decreases, so as to extend over the reduced machining-accuracy area 27, in which the machining accuracy is likely to deteriorate, the contact failure between the spiral wraps 15B and 16B resulting from the influence of the reduced machining-accuracy area 27 can be avoided.

As a result, both improved productivity resulting from increasing the machining speed of the stationary scroll 15 and the orbiting scroll 16, and maintenance of the compression performance resulting from avoiding the contact failure between the spiral wraps 15B and 16B, which causes gas leaks, can be achieved.

Further, in the present embodiment, the above-described thinned section 26 is formed by applying the surface treated film 28 onto the wrap surfaces, of the spiral wraps 15B and 16B, excluding the thinned section 26. Specifically, in the scroll compressor 1, in order to reduce the abrasion and the sliding friction or to prevent the mutual sticking and the like, the surface treated film 28 is provided on the surfaces of the end plates 15A and 16A and the spiral wraps 15B and 16B of the stationary scroll 15 and the orbiting scroll 16. Examples of the surface treated film 28 include the alumite film formed by anodizing the surface of the aluminum material, the fluorine-based resin (PTFE) film, the nickel/phosphorous film, or the nickel/boron film.

When applying the surface treated film 28, by applying the above-described surface treated film 28 while masking the thinned section 26, the thinned section 26 can be formed without carrying out any special processing. In this way, by applying the surface treated film 28 of a predetermined thickness onto a section excluding the thinned section 26, the thinned section 26 can be easily formed in a required section of the spiral wraps 15B and 16B in a low-cost manner, without any additional cost.

Second Embodiment

Figure 6:
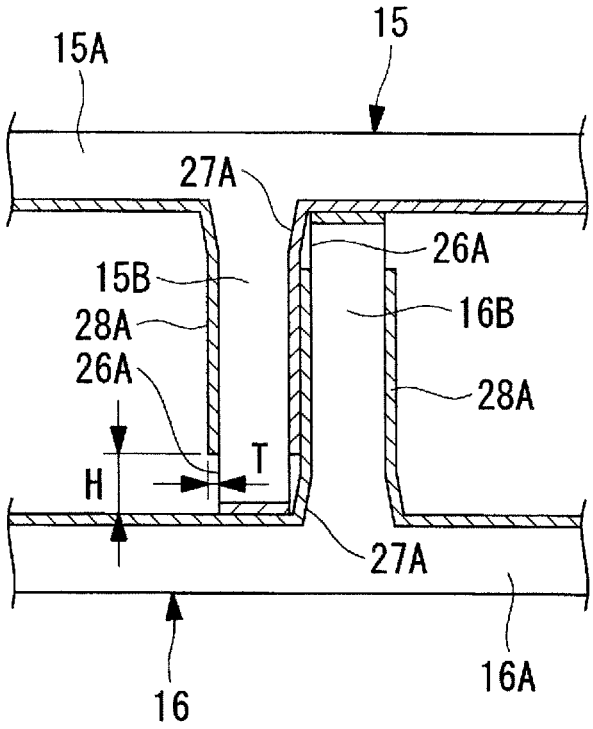
FIG. 6 is a cross-sectional view illustrating an engaged state of a stationary scroll and an orbiting scroll of a scroll fluid machine according to a second embodiment of the present invention.

Next, a second embodiment of the present invention will be described with reference to FIG. 6.

The present embodiment is different from the above-described first embodiment in that the present embodiment is configured to be able to deal with not only the deterioration in the machining accuracy in the section where the wrap height of the spiral wraps 15B and 16B of the stepped scrolls changes, but also deterioration in the machining accuracy over the entire base portion of the spiral wrap 15B and 16B. Since other points are similar to the first embodiment, a description thereof is omitted.

The present embodiment can be applied to a scroll compressor (a scroll fluid machine) having either the two-dimensional compression structure or the three-dimensional compression structure. As described above, regardless of whether or not the step part is provided therein, by increasing the scroll machining speed, a taper-shaped protrusion (a reduced machining-accuracy area 27A) is susceptible to be generated at the base portion of the spiral wrap 15B and 16B of the stationary scroll 15 and the orbiting scroll 16, as illustrated in FIG. 6.

Further, as described above, with respect to the reduced machining-accuracy area 27A, by providing a thinned section 26A in the front-side surface or the rear-side surface of the tooth tip section of at least one or both of the spiral wraps 15B and 16B of at least one of the partner scrolls 15 and 16 in the direction in which the wrap thickness decreases, the contact failure between the spiral wraps 15B and 16B, which causes gas leaks, can be avoided.

In the present embodiment, the thinned section 26A is formed by applying a surface treated film 28A onto the wrap surfaces of the spiral wraps.

Specifically, because the spiral wraps 15B and 16B of the stationary scroll 15 and the orbiting scroll 16 slide in the mutually engaged state, the surface treated film 28A is applied onto the surfaces of the stationary scroll 15 and the orbiting scroll 16 in order to reduce the abrasion and the sliding friction or to prevent the mutual sticking and the like. Examples of the surface treated film 28A include the alumite film formed by anodizing the surface of the aluminum material, the fluorine-based resin (PTFE) film, the nickel/phosphorous film, or the nickel/boron film. When applying the surface treated film 28A, by carrying out the surface treatment while masking the thinned section 26A, the thinned section 26A corresponding to the thickness of the surface treated film 28A is formed over a range of the masking at the same time as the surface treatment. For example, the thinned section 26A with the height-direction dimension H of approximately from 1 to 10 mm and the thickness-direction dimension T of approximately 10 μm can be set on the front-side surface or the rear-side surface of the tooth tip section of the spiral wraps 15B and 16B.

When the scroll machining speed is increased, the taper-shaped protrusion and the like is formed on the highly rigid base portion of the spiral wrap 15B and 16B, and the reduced machining-accuracy area 27A is generated. In response to this, when applying the surface treated film 28A, by applying the surface treated film 28A while masking the thinned section 26A, the thinned section 26A can be formed on the front-side surface or the rear-side surface of the tooth tip section of at least one or both of the spiral wraps 15B and 16B of at least one of the partner scrolls 15 and 16 without carrying out any special processing.

As a result, by simply applying the surface treated film 28A of the predetermined thickness onto a section excluding the thinned section 26A, the thinned section 26A can be easily formed without any additional cost. Further, both the improved productivity resulting from increasing the scroll machining speed, and the maintenance of the compression performance resulting from avoiding the contact failure between the spiral wraps 15B and 16B, which causes gas leaks, can be achieved.

Third Embodiment

Figure 7:
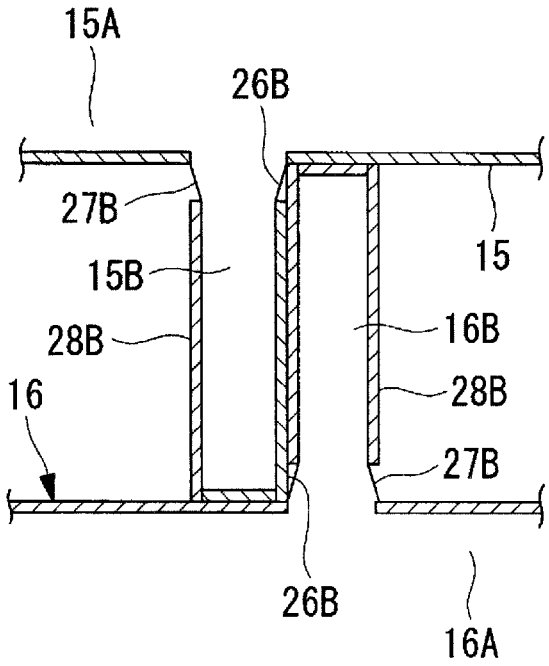
FIG. 7 is a cross-sectional view illustrating an engaged state of a stationary scroll and an orbiting scroll of a scroll fluid machine according to a third embodiment of the present invention.

Next, a third embodiment of the present invention will be described with reference to FIG. 7.

The present embodiment is different from the above-described second embodiment in that the thinned section 26B is formed such that a reduced machining-accuracy area 27B formed on the base portion of the spiral wrap 15B and 16B is included in a thinned section 26B. Since other points are similar to the first and second embodiments, a description thereof is omitted.

The present embodiment has a configuration in which, with respect to the reduced machining-accuracy area 27B, which is formed on the base portion of the spiral wrap 15B and 16B of the stationary scroll 15 and the orbiting scroll 16 as a result of increasing the scroll machining speed, by providing the thinned section 26B including the reduced machining-accuracy area on the front-side surface or the rear-side surface of a base section of at least one or both of the spiral wrap 15B and 16B of at least one of the scrolls 15 and 16 in the direction in which the wrap thickness decreases, the contact failure between the spiral wraps 15B and 16B, which causes gas leaks, is avoided.

Specifically, because the spiral wraps 15B and 16B of the stationary scroll 15 and the orbiting scroll 16 slide in the mutually engaged state, a surface treated film 28B is applied to the surfaces of the stationary scroll 15 and the orbiting scroll 16 in order to reduce the abrasion and the sliding friction or to prevent the mutual sticking and the like, as described above. When applying the surface treated film 28B, by carrying out the surface treatment while masking the thinned section 26B, which includes the reduced machining-accuracy area 27B formed on the base portion of the spiral wrap 15B and 16B, the thinned section 26B corresponding to the thickness of the surface treated film 28B is formed on the masked area at the same time as the surface treatment. For example, the thinned section 26B with the height-direction dimension H of approximately from 1 to 10 mm and the thickness-direction dimension T of approximately 10 μm can be set on the front-side surface or the rear-side surface of the base section of the spiral wrap 15B and 16B.

Thus, when applying the surface treated film 28B, by applying the surface treated film 28B while masking the thinned section 26B, the thinned section 26B including the reduced machining-accuracy area 27B can be formed on the front-side surface or the rear-side surface of the base section of at least one or both of the spiral wraps 15B and 16B of at least one of the stationary and orbiting scrolls 15 and 16 without carrying out any special processing.

Therefore, according to the present embodiment also, by applying the surface treated film 28B of the predetermined thickness onto a section excluding the thinned section 26B, the thinned section 26B can be easily formed without additional costs. Further, both the improved productivity resulting from increasing the scroll machining speed, and the maintenance of the compression performance resulting from avoiding the contact failure between the spiral wraps 15B and 16B, which causes gas leaks, can be achieved.

Note that the present invention is not limited to the invention according to the above-described embodiments and can be modified as required without departing from the spirit of the present invention. For example, although, in the above-described embodiments, an example is described in which the present invention is applied to a scroll compressor, it goes without saying that the present invention can be applied to a scroll expander or a scroll pump in a similar manner. Further, although, in the above-described embodiments, an example is described in which the present invention is applied to an open-type scroll compressor, as a matter of course, the present invention may be applied to a closed-type scroll compressor with a built-in compression mechanism and a built-in motor.

Further, as a stepped scroll compressor, a stepped scroll compressor is described above in which the step parts 15E and 15F and the step parts 16E and 16F are respectively provided at the positions along the spiral direction of the tooth crests 15C and 16C and the tooth bases (end plate surfaces) 15D and 16D of the spiral wraps 15B and 16B of both the stationary scroll 15 and the orbiting scroll 16. However, as a matter of course, the present invention can be applied, in a similar manner, to a stepped scroll compressor in which a step part is provided only at a predetermined position along the spiral direction of a tooth base of a spiral wrap of one of a stationary scroll and an orbiting scroll, and a step part is provided only at a predetermined position along the spiral direction of a tooth crest of a spiral wrap of the other of the stationary scroll and the orbiting scroll.

REFERENCE SIGNS LIST

1 Scroll compressor (scroll fluid machine)
15 Stationary scroll
16 Orbiting scroll
15A, 16A End plate
15B, 16B Spiral wrap
15E, 15F, 16E, 16F Step part
26, 26A, 26B Thinned section
27, 27A, 27B Reduced machining-accuracy area
28, 28A, 28B Surface treated film

The invention claimed is:

1. A scroll fluid machine comprising:

a pair of a stationary scroll and an orbiting scroll provided with vertically-disposed spiral wraps on end plates thereof, the spiral wraps being mutually opposed to and engaged with each other;

a taper-shaped protrusion formed on a base section of at least one of the spiral wraps of at least one of the stationary scroll and the orbiting scroll; and a thinned section provided on a front-side surface or a rear-side surface of a tooth tip section of at least one of the spiral wraps of at least one of the stationary scroll and the orbiting scroll in a direction in which a wrap thickness decreases and in correspondence with the protrusion;

the thinned section being formed by applying a surface treated film onto a wrap surface of the spiral wrap excluding the thinned section.

2. A scroll fluid machine comprising:

a pair of a stationary scroll and an orbiting scroll provided with vertically-disposed spiral wraps on end plates thereof, the spiral wraps being mutually opposed to and engaged with each other;

a taper-shaped protrusion formed on a base section of at least one of the spiral wraps of at least one of the stationary scroll and the orbiting scroll;

a thinned section provided on a front-side surface or a rear-side surface of the base section on which the taper-shaped protrusion is formed, in a direction in which a wrap thickness decreases; and the thinned section being formed by applying a surface treated film onto a wrap surface of the spiral wrap excluding the thinned section.

3. A scroll fluid machine comprising:

a pair of a stationary scroll and an orbiting scroll provided with vertically-disposed spiral wraps on end plates thereof, the spiral wraps being mutually opposed to and engaged with each other;

a step part that is higher on a center side and lower on an outer circumferential side along the spiral wrap provided on the end plate of at least one of the stationary scroll and the orbiting scroll;

a step part that is lower on the center side and higher on the outer circumferential side along the spiral wrap being provided on the spiral wrap of the other one of the stationary scroll and the orbiting scroll, in correspondence with the step part of the end plate;

a taper-shaded protrusion formed on a base section of the spiral wrap of the scroll in correspondence with a position at which a wrap height of the spiral wrap changes due to the step part on the end plates of at least one of the stationary scroll and orbiting scroll; and a thinned section provided on a front-side surface or a rear-side surface of a tooth tip section of at least one of the spiral wraps of at least one of partner scrolls engaging with the scroll on which the taper-shaped protrusion is formed, the thinned section being provided in a direction in which a wrap thickness decreases, so as to correspond to the taper-shaped protrusion and to extend over at least an area where machining becomes discontinuous due to a change in the wrap height.

4. The scroll fluid machine according to claim 3, wherein the thinned section is formed by applying a surface treated film onto a section excluding the thinned section on a wrap surface of the spiral wrap.

* * * * *